United States Patent [19]

Dyett et al.

[11] Patent Number: 4,572,352

[45] Date of Patent: Feb. 25, 1986

[54] APPARATUS FOR CONVEYING ROD-LIKE ARTICLES

[75] Inventors: Derek H. Dyett; Grantley R. Hoath; John K. Horsley, all of High Wycombe, England

[73] Assignee: Molins Limited, London, England

[21] Appl. No.: 254,283

[22] Filed: Apr. 15, 1981

[30] Foreign Application Priority Data

Apr. 15, 1980 [GB] United Kingdom ..... 8012337
May 19, 1980 [GB] United Kingdom ..... 8016499

[51] Int. Cl.[4] ..... B65G 47/26

[52] U.S. Cl. ..... 198/457; 198/575; 198/601; 198/831; 198/951

[58] Field of Search ..... 198/347, 831, 587, 601, 198/572, 573, 575, 577, 530, 531, 532, 524, 526, 951, 457, 570, 584

[56] References Cited

U.S. PATENT DOCUMENTS

| | | | |
|---|---|---|---|
| 2,509,752 | 5/1950 | Wheeley | 198/951 |
| 3,470,998 | 10/1969 | Zuercher | 198/457 |
| 3,565,237 | 2/1971 | Strydom | 198/525 |
| 4,241,822 | 12/1980 | Molins et al. | 198/831 |
| 4,344,521 | 8/1982 | Bennett et al. | 198/951 |

FOREIGN PATENT DOCUMENTS

| | | | |
|---|---|---|---|
| 1873062 | 5/1963 | Fed. Rep. of Germany | 198/951 |
| 2652363 | 5/1978 | Fed. Rep. of Germany | 198/347 |
| 623481 | 4/1949 | United Kingdom | 198/584 |
| 589958 | 1/1978 | U.S.S.R. | 198/831 |

*Primary Examiner*—Robert J. Spar
*Assistant Examiner*—Jonathan D. Holmes
*Attorney, Agent, or Firm*—Antonelli, Terry & Wands

[57] ABSTRACT

Apparatus for conveying rod-like articles, especially cigarettes, includes parallel opposed conveyors for delivering articles to a downwardly-extending junction provided with an arrangement for priming the junction such as a pivoted plate or retractable conveyor bands. The stream on one of the opposed conveyors may be delivered from a further conveyor by a rotary disc transfer conveyor which turns articles through 180° for delivery to the one conveyor. The further conveyor may be parallel to the opposed conveyors or may be mounted at an adjustable small angle to them. The apparatus is particularly useful for tip-turning of cigarettes at the exit of a filter cigarettes assembling machine.

7 Claims, 4 Drawing Figures

APPARATUS FOR CONVEYING ROD-LIKE ARTICLES

This invention relates to apparatus for conveying rod-like articles such as cigarettes or cigarette filter rods.

A typical machine for assembling filter cigarettes delivers two separate rows of filter cigarettes with the filter ends of the cigarettes facing one another. Before the two rows can be combined for further handling of the cigarettes it is desirable that the cigarettes in one row are turned so that their filter ends face the same way as those in the other row; this process is called "tip-turning". The present invention is usefully (but not exclusively) applied to "tip-turning" of filter cigarettes.

According to one aspect of the invention apparatus for conveying rod-like articles, comprises a first conveyor for a first stream of rod-like articles in stack formation at a first level, a second conveyor for a second stream of rod-like articles in stack formation at the first level, a third conveyor for conveying said second stream at the first level, means for transferring the second stream from the second to the third conveyor, a junction between said first and third conveyors, and a fourth conveyor for moving the first and second streams combined away from the junction at a second level.

In a preferred arrangement for the first, second and third conveyors are substantially parallel, with the first and second conveyors moving in the same direction and the third conveyor moving in an opposite direction. The first and third conveyors may be opposed and separated by the junction. A chute may lead down or an elevator lead up from the junction to the fourth conveyor.

The means for transferring the second stream from the second to the third conveyor preferably comprises a transfer conveyor, which may move the stream through about 180° around a substantially vertical axis. The transfer conveyor may be substantially as disclosed in British Patent Specification No. 2007964. Alternatively, the transfer conveyor may define a substantially similar path to the conveyor disclosed in said specification but consist of flexible plastics material in the form of a disc constrained to move along a blanked path around a substantially vertical axis. The central portion of the transfer conveyor preferably comprises a hub having inwardly inclined sides which may support the inner ends of the articles on the banked portion of the conveyor. Transfer from the second conveyor onto the transfer conveyor and from the transfer conveyor onto the third conveyor may be by way of dead plates adapted to reorientate or straighten the articles during transfer. For example, the line of transfer between the dead plates and the transfer conveyor need not be parallel to the passing articles, so that one end or part of the lowermost articles in the stream is contacted before the other end or parts.

The junction may be provided with priming means comprising a band or other element intended to restrict exit from (or possibly entry to) the junction until there is a sufficient pressure of articles moving into (or towards) the junction; the leading articles are thus bounded and controlled to prevent misalignment or twisting when travelling through the junction. The priming means may comprise means responsive to pressure of articles in or adjacent the junction and could include resiliently-loaded drive bands which extend across the junction to substantially close it until the pressure of articles in the junction overcomes the resilient loading. For example the band could normally be curved by pressure of articles and convey the articles in a curved path leading from the junction to the fourth conveyor. Alternatively, or additionally, a flexible curtain of relatively heavy material (e.g. chain-mail) could extend in the junction. Another possibility is a pivoted plate movable through the junction and optionally controlled by a level sensor connected to a drive motor for the plate. A still further possible arrangement is a sensor or pressure plate associated with the junction (e.g. above it) and linked to mechanism for restricting the width of the exit from the junction; as pressure builds up in the junction the sensor operates the linkage to increase the width of the exit and allow articles to pass from the junction.

According to another aspect of the invention apparatus for combining streams of rod-like articles moving in stack formation in substantially opposite directions, comprises a junction zone for said streams, a channel for delivering articles away from the junction zone, and means for priming the junction zone including means restricting exit from the junction until sufficient pressure of articles has built up in or upstream of the junction. The priming means may take any of the forms already described.

A further aspect of the invention provides apparatus for conveying rod-like articles, including means for conveying parallel streams of rod-like articles, first and second conveyor means for respectively receiving said streams and for conveying said streams in stack formation, transfer means for receiving the stream on said second conveyor means and for delivering said stream to a junction with said first conveyor means, said transfer means including means for moving said stream around a curved path to reorientate the articles of said second stream before said junction, wherein said second conveyor means is set at an angle to said first conveyor means and is supported by an adjustable mounting whereby said angle may be varied to suit the lengths of the conveyed rod-like articles.

The invention is particularly suited for use as or in tip turners. In this case, parallel streams of filter cigarettes are received from a filter cigarette assembling machine and a first stream passes to one side of the junction while the other stream passes to the other side of the junction, having been turned so that on combining beyond the junction the tips of the cigarettes are at corresponding ends in the combined stack. Priming means is particularly useful since one stream (the first) will normally arrive at the junction before the other because it has a shorter path length from the assembling machine. The priming means is preferably loaded so as to accept the first stream and pass it through the junction before the second stream reaches the junction; this avoids an undesirable build-up of cigarettes on the first side of the junction.

The invention will now be further described, by way of example only, with reference to the accompanying drawings, in which.

Figure 1:
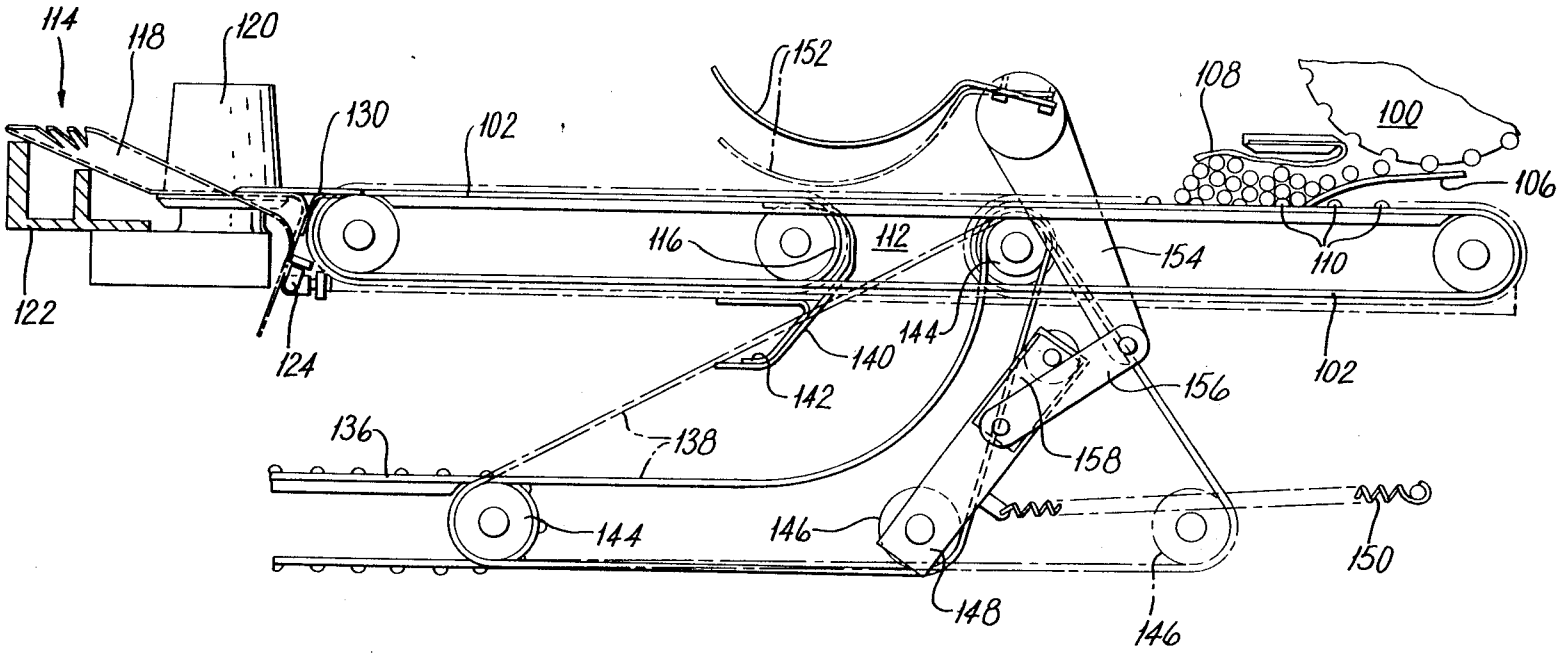
FIG. 1 is a side view of apparatus for conveying cigarettes.
Figure 2:
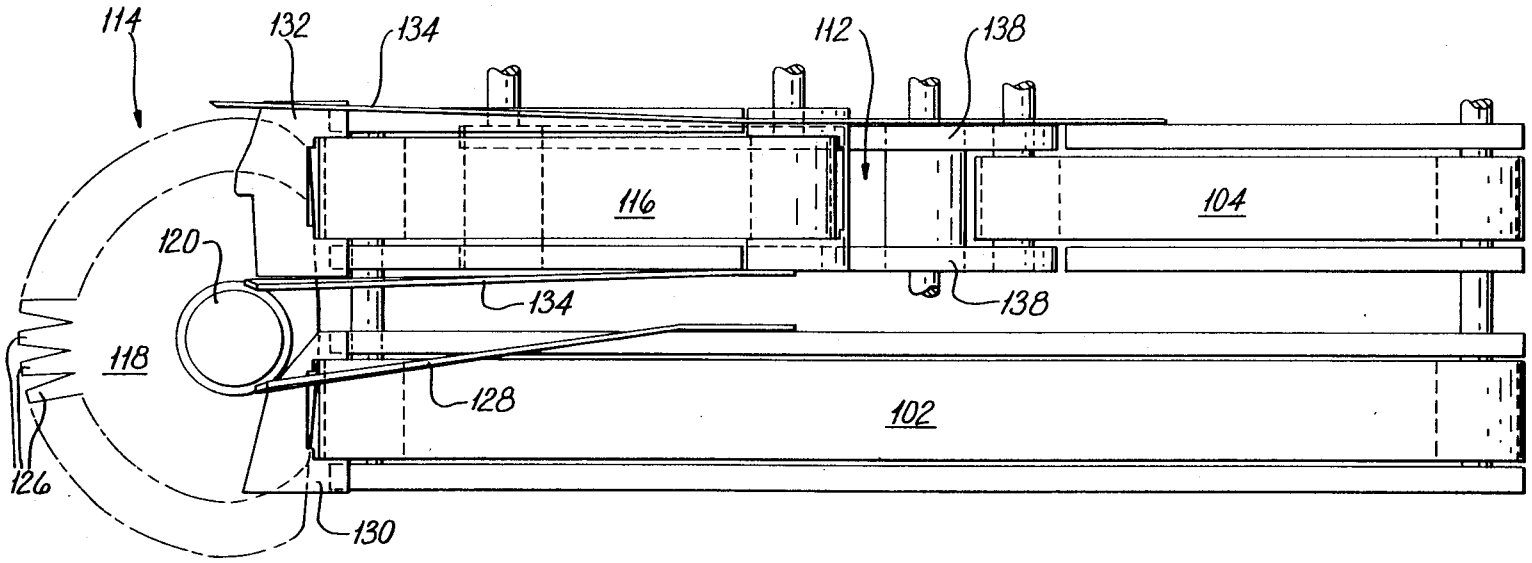
FIG. 2 is a plan view of the apparatus of FIG. 1.

FIGS. 1 and 2 show apparatus for conveying cigarettes away from a machine for assembling filter cigarettes, such as a Molins PA8. A final cut or delivery drum 100 of the plug assembling machine delivers two parallel streams of cigarettes with the filter tip ends of the cigarettes facing in opposite directions. Parallel band conveyors 102, 104 receive cigarettes from the respective stream on the drum 100. An inclined guide 106 transfers the cigarettes from the drum 100 onto the conveyor 102 underneath a flexible curtain 108. The curtain 108 helps initial formation of a stack on the conveyor 102. A plate and curtain (not shown) similar to the plate 106 and curtain 108 are associated with the conveyor 104 on which a stack is formed in the same way as on the conveyor 102. Each conveyor 102, 104 is formed with half-round pips or flights 110 to aid conveyance of the cigarettes.

The conveyor 104 leads to a junction 112. The conveyor 102 leads to a transfer conveyor 114 which turns the stream on conveyor 102 through approximately 180° and delivers it onto a further flighted band conveyor 116. The conveyor 116 delivers the stream from conveyor 102 to the side of the junction 112 opposite the conveyor 104.

The transfer conveyor 114 comprises a substantially circular disc 118 of flexible plastics material rotatable about a substantially vertical axis and including a central rotatable frusto-conical hub 120. The disc 118 is constrained to have a substantially horizontal surface for receiving cigarettes from the conveyor 102 and for delivering cigarettes to the conveyor 116. Intermediate these positions, on the conveying side of the disc the outer surface is elevated by guide means 122 to provide a banked path for the cigarettes, thereby allowing a particularly small radius bend. Opposite its banked portion the disc 118 is depressed below the level of the conveyors 102 and 116 by adjustable guide means 124. The guide means 124 may extend to a point adjacent the conveyor 116. For example, an additional guide adjacent the periphery of the disc 118 at its point of greatest radius may be required near the conveyor 116, to avoid excessive distortion of the disc. The outer periphery of the disc 118 is slit to form fingers 126, in order to allow flexing of the disc without kinking.

A stationary guide 128 progressively moves cigarettes outwardly of the conveyor 102 for entry onto the disc 118 of the transfer conveyor 114. The flights 110 on the conveyor 102 help to maintain the cigarettes parallel. A dead plate 130 is positioned between the end of the conveyor 102 and the disc 118 for transfer of cigarettes therebetween. The trailing edge of the dead plate 130 is inclined at about 140° relative to the axis of the cigarettes; this has been found to aid smooth transfer onto the disc 118.

On the transfer conveyor 114 the cigarettes are progressively elevated by the disc 118 and then maintained at a constant inclination until the guide means 122 allows the disc to progressively lower and deliver the cigarettes onto a dead plate 132 for transfer to the conveyor 116. The plate 132 has a projecting element for helping to strip the cigarettes from the disc 118. Inwardly directed side guides 134 align the stream on the conveyor 116.

After the plug assembling machine has been operating for some time opposed streams of cigarettes are delivered respectively by the conveyors 104 and 116 to the junction 112. The streams are combined at the junction 112 and descend for delivery by a flighted conveyor 136. At and below the junction 112 a pair of transversely-spaced resiliently-loaded conveyor bands 138 define the path from the conveyors 104 and 116 to the conveyor 136. On the opposite side of the junction 112 to the bands 138 a flexible curtain 140 (shown in FIG. 1 in the position it would assume when the junction is full of cigarettes) is suspended from a position adjacent the end of conveyor 116. A stationary guide surface 142 defines the limit of the movement of curtain 140.

The bands 138 pass around two fixed rollers 144 and a movable roller 146 mounted on a pivoted arm 148 and resiliently loaded by a spring 150. When the bands 138 are not subject to pressure from cigarettes in and below the junction 112 the spring 150 causes the roller 146 to move to the position shown in chain-dot lines in FIG. 1 so that the bands 138 are stretched between the rollers 144 and effectively close the exit from the junction 112, as also shown in chain-dot lines. The curtain 140 would then extend vertically downwards from its fixing position adjacent the end of conveyor 116.

Assuming that the junction 112 is empty and that the filter assembling machine is then started the stream of cigarettes on the conveyor 104 reaches the junction 112 with the exit substantially closed as just described. Increasing pressure from the cigarettes progressively causes the bands to move downwards and thus open the exit to the junction. In order to direct the pressure onto the bands a horizontally pivoted pressure plate (not shown) may be positioned above the junction 112 to prevent substantial upward movement of the cigarettes at the junction. The apex between the curtain 140 and the bands 138 progressively advances with the stream until the junction 112 and the region between the bands 138 and the guide surface 142 is full, the leading cigarettes being constantly maintained under control to prevent skewing or misalignment. The bands 138 might not be fully retracted against the tension of spring 150 until the stream from the conveyor 116 also reaches the junction 112. A curved backing plate (not shown) may define the maximum position of the bands 138 as shown in FIG. 1.

As an alternative or in addition to the use of a spring 150 the pressure above the junction 112 may be used to control positioning of the bands 138. Thus a pivoted curved pressure sensor 152 may operate through a linkage comprising levers 154, 156, 158 and 148 to move the roller 146. Thus as pressure builds up over the junction 112 the roller 146 is advanced to the left (as shown in FIG. 1) to allow the bands 138 to become curved and open the exit to the junction 112. It should be noted that the sensor 152 is asymmetrically positioned over the junction 112: this is so that the sensor 152 is optimally positioned for reaction to the stream on conveyor 104, which is the stream for which priming is usually necessary.

It is possible that a sensor could be positioned over the junction 112 to control the speed of the bands 138 and/or the conveyor 136. However, since the apparatus is associated with a filter cigarette assembling machine which is delivering cigarettes at a known rate it is normally unnecessary to provide such control, the relative speeds of the conveyors and bands being preset. In this respect it should be noted that the conveyors 102 and 104 normally travel at the same speed, being lower than the peripheral speed of the drum 100. Preferably the speed of conveyors 102 and 104 is constantly related to the speed of drum 100 (and hence to that of the assembling machine). The conveyor 116 travels at the same speed as the conveyor 102, with the transfer conveyor 114 travelling at a corresponding speed. The speed of conveyor 136 need not be twice that of the conveyors 104 and 116 since the stack height may be increased on the conveyor 136. The bands 138 may be driven at a speed corresponding to that of the conveyor 136 or may be driven at a different speed (either faster or slower). In this respect it should be noted that the bands 138 are not flighted.

Reference is directed to British Patent Specifications Nos. 1453191 and 1540831 which disclose band tensioning arrangements which may be incorporated in priming means for the arrangement of the present invention.

Figure 3:
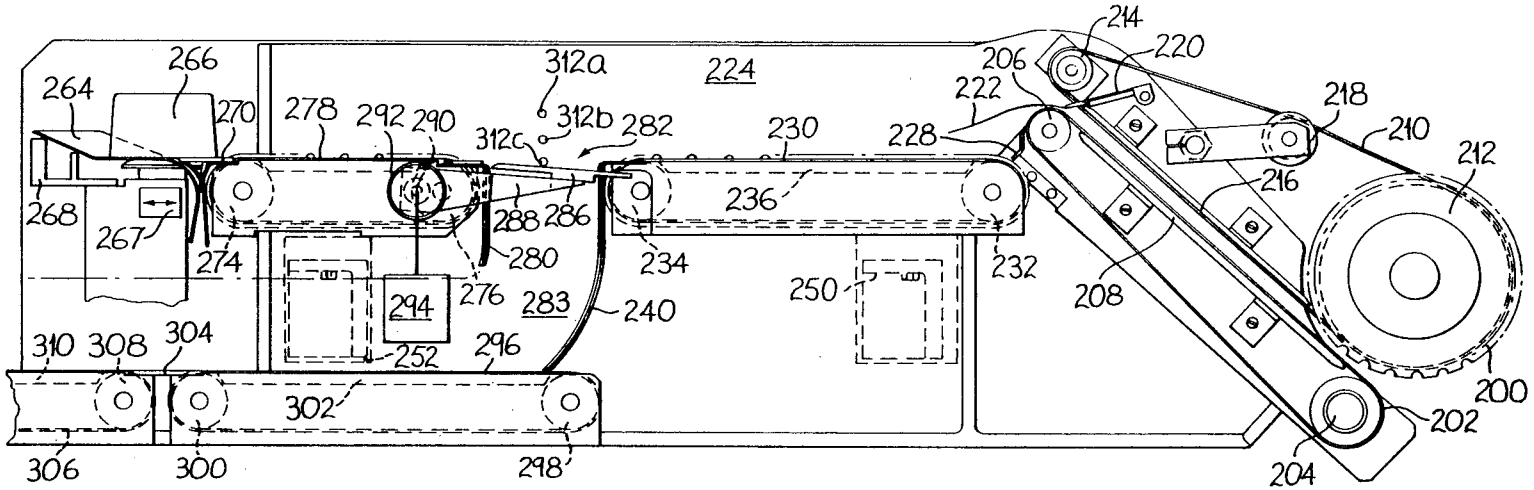
FIG. 3 is a side view of further apparatus for conveying cigarettes.
Figure 4:
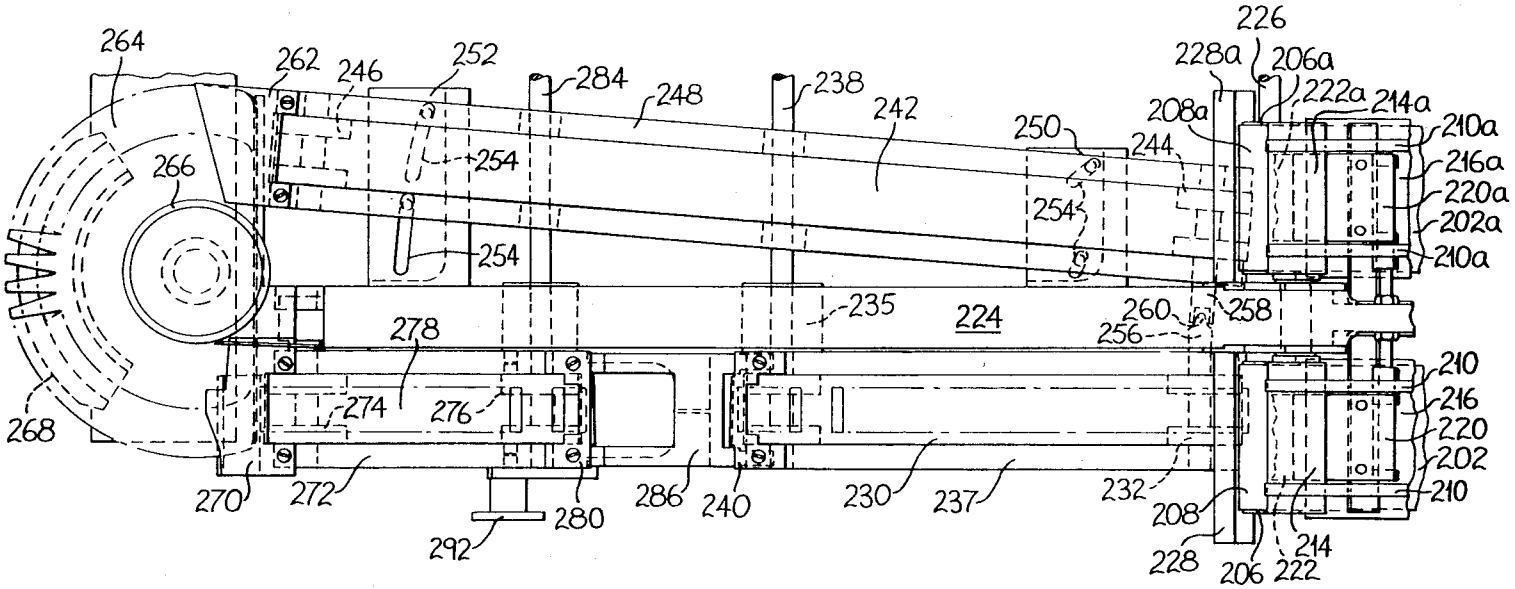
FIG. 4 is a plan view of part of the apparatus of FIG. 3.

FIGS. 3 and 4 show further apparatus for conveying cigarettes away from a filter cigarette assembling machine, such as a Molins PA8. The machine includes a fluted suction delivery drum 200 which has a delivery position arranged opposite an inclined run of a timing band 202 passing around pulleys 204, 206 and over a backing plate 208. A pair of cog wheels 212, co-axial with and axially outside the drum 200, support and drive a pair of spaced timing bands 210 having inclined runs, defined by a backing plate 216, parallel to that of the band 202, and defining a channel for upward passage of cigarettes. The bands 210 pass around an upper pulley 214 and are tensioned by a spring loaded pulley 218. A pivoted flap 220 extends between the bands 210 adjacent the pulleys 206 and 214 and carries a strip of flexible chain-mail 222 extending over and beyond the band 202 passing over pulley 206. A guide 228 extends downwardly from a position close to the pulley 206.

The delivery drum 200 and bands 202 and 210 convey one of two parallel streams of cigarettes issuing from the assembling machine. The pulleys 204, 206, 214 and related apparatus are supported on one side of a substantially upright center plate 224. The other stream of cigarettes is conveyed by a substantially similar conveying arrangement mounted on the other side of the center plate 224. Thus there is a second delivery drum (not shown) which is co-axial with the drum 200, and upper and lower bands 210*a* and 202*a* (FIG. 4) respectively. Where appropriate, parts of the apparatus for conveying the second stream and shown in FIG. 4 have been given reference numbers corresponding to the reference numbers of those parts already described but with the addition of the suffix "a".

The bands 210 and 210*a* are driven by their respective cog wheels associated with the fluted delivery drums. The bands 202 and 202*a* are driven through the pulleys 206 and 206*a* by a drive shaft 226 extending from a motor compartment (not shown).

Returning now to the bands 202, 210 for the first stream a substantially horizontal timing band 230 extending between pulleys 232 and 234 has an upper run lying in a shallow well 236 in a support member 237. The upper surface of the band 230 and the outer upper sides of the support member 237 are substantially level. At the end of the band 230, adjacent the pulley 234, an angled guide 240 having a downwardly-extending curved portion is connected to the member 237. The band 230 is driven by a drive shaft 238 connected to the pulley 234 and passing through a bearing 235 in the center plate 224. The support member 237 is itself supported by and connected to the center plate 224.

At the end of bands 202*a* and 210*a* a substantially horizontal band 242 extends between pulleys 244 and 246, the band running in a shallow well of a support member 248 which carries the pulleys. Brackets 250, 252 connected to the center plate 224 are provided with arcuate slots 254 through which the support member 248 is adjustably mounted by means of bolts so that its inclination to the center plate 224, and to the line of bands 202, 202*a*, 210, 210*a*, may be adjusted.

Pulley 244 is provided with a stub shaft 258 which is connected to a similar stub shaft 256 extending from pulley 232 by an essex universal joint 260. The band 242 is thus driven by the drive shaft 238 acting through the band 230 and shafts 256 and 258.

A transfer plate 262 is connected to the support member 248 at its downstream end and lies adjacent a flexible transfer disc 264 having a hub 266 with an inclined annular wall. The disc 264 is constrained by guide means 268 so that its outer surface is elevated. The construction and operation of the disc 264 is substantially similar to that of the disc 118 described with reference to FIGS. 1 and 2. Drive for the disc 264 is taken through a right-angled connection from the motor compartment (not shown).

A support member 272 connected to the center plate 224 on the same side as the support member 237 (and on the opposite side to the member 248) carries a transfer plate 270 for receiving cigarettes from the transfer disc 264. Pulleys 274 and 276 are mounted on the member 272 and carry an endless timing band 278. A drive shaft 284 extends from the motor compartment (not shown) to the pulley 276 for driving the band 278. A downwardly-extending guide 280 is connected to the support member 272 adjacent the pulley 276 and faces the guide 240 to define a junction zone 282. Vertically-spaced photosensors 312*a*, 312*b* and 312*c* are provided in the junction zone 282 (supported by the center plate 224).

A priming plate 286 which is bifurcated so that it can clear the guides 240 and 280 is supported by a single bracket 288 rotatable about a spindle 290 carried by the member 272. An operating knob 292 is provided for rotating the plate 286 through about 180° from the position shown in the drawings to a position where it may be latched underneath the support member 272. As an alternative, drive means 294 for moving the plate 286 may be provided, together with means for controlling the motor in accordance with signals from the sensors 312.

A conveyor band 296 is provided below the junction zone 282 and short channel 283 defined between guides 240 and 280. The band 296 is carried by pulleys 298 and 300 and runs over a backing plate 302. A further band 306 passing around a pulley 308 and over a backing plate 310 is aligned with band 296 and separated from it by a dead plate 304. Bands 296 and 306 are driven by drive shafts (not shown) extending from the motor compartment (not shown) and are supported by members connected to the center plate 224.

In operation cigarettes are delivered in single row streams from the delivery drum 200 and its equivalent for the other streams. The cigarettes are stripped from the drums and conveyed upwards between the bands 202, 210 and 202*a*, 210*a*, from the upper ends of which they descend onto bands 230 and 242 respectively which are moving more slowly than the former bands. Normally the relative speeds are such that a multi-layer stream of about four cigarettes in depth is carried on the bands 230 and 242. The pivoted flaps and chain-mail 220, 222 and 220*a*, 222*a* help to maintain alignment of the cigarettes as the stack is formed on the respective conveyors, especially when the stack is being initially formed.

The moving stack on band 230 progresses to the junction zone 282 where, initially, the priming plate 286 is held in the position shown in the drawings. As cigarettes accumulate in the junction zone 282 the priming plate is progressively lowered by rotating the knob 290 in a clockwise direction until the junction zone 282 and channel 283 are full of cigarettes. When a stack is established on the conveyor 296 the priming plate is latched above it and under the support member 272 and is not needed again until re-priming of the junction is necessary.

Instead of using the knob 290 the priming plate 286 could be driven downwards by motor 294 in accordance with signals from the sensors 312, the movement being controlled so that the junction zone remains full of cigarettes.

Although description of the operation of the priming operation has assumed that the junction zone 282 will be provided with cigarettes solely by the band 230 (since normally cigarettes on this band will reach the junction first) the priming operation is in principle the same if the stream on band 278 is additionally or alternatively the supply for priming.

Whether priming is carried out manually or by means of the motor 294 movement of the priming plate 286, and subsequently of the conveyors 296 and 306, should ensure that the junction zone 282 and channel 283 remain full of cigarettes with no spaces where individual cigarettes could become misaligned.

The stack formed on band 242 is conveyed towards the transfer disc 264 at a relatively small angle, as shown in the drawings. The cigarettes remain parallel to their original direction (i.e. at a small angle to the conveying direction of the band 242). Transparent plastics walls (not shown in the drawings) extend along-side the edges of the band 242 and help to maintain alignment of the cigarettes on the band. The walls are movable with the support member 248 and are laterally adjustable to vary their spacing. Similar walls are provided for the band 230 and may be provided for the band 278.

Transfer of the stack on band 242 onto the transfer disc 264 and subsequently onto the conveyor 278 is substantially as described with reference to the transfer disc 118 in FIGS. 1 and 2. The band 278 is preferably provided with flights disposed at right-angles to the longitudinal dimension of the band, to help align the cigarettes leaving the transfer disc 264. The band 230 need not have flights and the band 242 preferably does not have flights.

The apparatus is capable of conveying cigarettes having significantly different lengths. For short cigarettes the hub portion 266 may be replaced by a larger-diameter portion so that the outer ends of the cigarettes on the transfer disc 264 remain near the edge of the disc during conveyance. Similarly, for particularly long cigarettes a smaller-diameter hub portion 266 may be used. The angle of the support member 248 is adjusted, by loosening the bolts in slots 254 and subsequently retightening, so that the inner ends of the cigarettes conveyed on band 242 are aligned with the hub portion 266 in use. As a fine adjustment the axis of the transfer disc 264 and hub 266 may be moved slightly in a direction generally parallel to the length of the center plate 224, to ensure that the hub portion 266 cooperates correctly with the transfer plates 262 and 270. The means of adjustment is indicated diagrammatically in FIG. 3 at 267.

In normal operation, after priming has taken place, the junction zone 282 and channel 283 receive cigarettes from stream on conveyors 278 and 230. The height of these streams is typically four cigarettes deep. A stream which is typically twelve cigarettes deep (approximately 90 mm) is formed on conveyor 296. The speed of conveyor 296 is controlled in accordance with the level of cigarettes in the junction zone 282 using the sensors 312. The sensors 312 are set such that the acceptable level of cigarettes in the junction zone lies between the upper sensor 312*a* and the middle sensor 312*b*. With this level there is sufficient head of cigarettes in the junction zone 282 to ensure that no voids occur in the zone or in the channel 283.

A typical control cycle for the speed of conveyor 296, based on a nominal conveyor speed V which is related to the speed of the assembling machine so that a stack of the required mean height is formed, would be to drive the conveyor at V+10% if sensor 312*a* is covered and at V−10% if sensor 312*b* is uncovered, and to stop the conveyor if sensor 312*c* is uncovered. The conveyor 296 would then normally alternate in speed between V+10% and V−10%. It would, of course, be possible to provide for the conveyor 296 to be driven at V when sensor 312*a* is uncovered and sensor 312*b* is covered. During priming, control of the priming plate 286 by the motor 294 could be achieved in a similar manner to maintain the level of cigarettes in the junction between the sensors 312*a* and 312*b*. The conveyor 296 would be held stationary until the priming plate 286 is clear of the newly-formed stack and latched under the support member 272. Note that the priming plate is constructed so that cigarettes are controlled and bounded by it well beyond the guide 240 and along the conveyor 296.

As shown in FIGS. 3 and 4 the right-hand stream of cigarettes issuing from the assembling machine is turned on the transfer disc 264. In some instances it may be desired to turn the left-hand stream rather than the right-hand stream; while this requires a modified conveyor layout (basically an interchange of the conveyors 230, 278 and 242 and associated apparatus) there is no particular difficulty in achieving this, and the fundamental principles of operation are identical.

In order to accommodate the slightly greater height at the filter tip ends of a stack of cigarettes the guides 240, 280 defining the channel 283 may each be inclined at about $1\frac{1}{2}°$ to a line perpendicular to the conveyors 230 and 278, so that in section the sides of the channel 283 are relatively inclined by about 3°.

We claim:

1. Apparatus for conveying rod-like articles, comprising a first conveyor for conveying a first stream of rod-like articles in stack formation at a first level; a second conveyor for conveying a second stream of rod-like articles in stack formation at the first level; a third conveyor for conveying said second stream at the first level; means for transferring the second stream from the second to the third conveyor, including a transfer conveyor having a path which is curved about an axis generally transverse to the articles on said conveyor and to their direction of conveyance; a junction between said first and third conveyors, a fourth conveyor for moving the first and second streams combined away from the junction at a second level; and means including stationary support surfaces for supporting said second stream between said second conveyor and said transfer conveyor and between said transfer conveyor and said third conveyor; wherein at least one of said surfaces has a transition with said transfer conveyor adapted to engage articles at an asymmetric position to aid transfer to or from the transfer conveyor.

2. Apparatus for conveying rod-like articles, including means for conveying parallel streams of rod-like articles, first and second conveyor means for respectively receiving said streams and for conveying said streams in stack formation, transfer means for receiving the streams on said second conveyor means and for delivering said stream to a junction with said first conveyor means, said transfer means including means for moving said stream around a curved path to reorientate the articles of said second stream before said junction, wherein said second conveyor means is set at an angle to said first conveyor means and is supported by an adjustable mounting whereby said angle may be varied to suit the lengths of the conveyed rod-like articles, including a stationary support surface arranged between said second conveyor means and said transfer means, said support surface having non-parallel leading and trailing transitions respectively with said second conveyor means and said transfer means.

3. Apparatus as claimed in claim 2, wherein the transfer means includes a generally circular conveyor having an inner hub portion and means for mounting said hub portion so that it is replaceable with a hub portion of different diameter for supporting the inner ends of cigarettes of different length on said circular conveyor, said second conveyor means being adjustable with respect to said hub portion so that the inner ends of the stream on said second conveyor means may be aligned with said hub portion.

4. Apparatus as claimed in claim 2, wherein said means for moving said stream around a curved path comprises a rotatable member and means defining an axis of rotation for said member, said axis defining means being movable towards and away from the second conveyor.

5. In a machine for producing filter cigarettes in which double length filter cigarettes are sub-divided to produce pairs of axially-aligned individual cigarettes, apparatus for conveying the cigarettes, comprising first and second stack forming means for respectively forming first and second multi-layer streams of filter cigarettes in stack formation, said streams having the filter tip ends of the cigarettes respectively facing in opposite directions in relation to their directions of movement; and means for delivering said streams on paths leading to a junction at which said streams are combined with the filter tip ends of the cigarettes facing in the same direction, said delivering means including transfer conveyor means for moving at least one stream around a path which is curved about an axis generally transverse to the cigarettes and to their direction of movement on the path, a further conveyor for delivering cigarettes to or receiving cigarettes from the transfer conveyor means; and a stationary support surface disposed between said transfer conveyor means and said further conveyor, said support surface having non-parallel edges forming transitions with said transfer conveyor means and further conveyor.

6. Apparatus as claimed in claim 5, wherein said support surface and said transfer conveyor means and further conveyor are arranged such that cigarettes in said stream are disposed at an angle to an edge forming a transition during passage thereover and undergo a change of direction during said passage.

7. Apparatus as claimed in claim 5, wherein the transfer conveyor means comprises a rotatable disc, substantially straight conveyors upstream and downstream of said disc, and stationary support surfaces between said disc and each of said substantially straight conveyors.

* * * * *